US007445741B2

(12) United States Patent
Poulakis et al.

(10) Patent No.: US 7,445,741 B2
(45) Date of Patent: Nov. 4, 2008

(54) METHOD FOR PRODUCING A TOUCH-AND-CLOSE FASTENER ELEMENT

(75) Inventors: Konstantinos Poulakis, Hildrizhausen (DE); Jan Tuma, Berlin (DE)

(73) Assignee: Gottlieb Binder GmbH & Co., Holzgerlingen (DE)

( * ) Notice: Subject to any disclaimer, the term of this patent is extended or adjusted under 35 U.S.C. 154(b) by 567 days.

(21) Appl. No.: 10/476,589

(22) PCT Filed: Apr. 25, 2002

(86) PCT No.: PCT/EP02/04554

§ 371 (c)(1),
(2), (4) Date: Oct. 31, 2003

(87) PCT Pub. No.: WO02/091870

PCT Pub. Date: Nov. 21, 2002

(65) Prior Publication Data

US 2004/0134045 A1 Jul. 15, 2004

(30) Foreign Application Priority Data

May 12, 2001 (DE) ..... 101 23 205

(51) Int. Cl.
*B28B 7/22* (2006.01)
*A44B 1/04* (2006.01)

(52) U.S. Cl. ..... 264/254; 264/167; 264/446; 264/447; 264/448; 264/211.13; 264/255; 264/259; 24/306; 24/442; 24/443; 24/451; 427/508; 427/385.5

(58) Field of Classification Search ..... None
See application file for complete search history.

(56) References Cited

U.S. PATENT DOCUMENTS

| | | | | |
|---|---|---|---|---|
| 3,176,364 | A * | 4/1965 | Dritz | 24/304 |
| 3,312,583 | A * | 4/1967 | Rochlis | 428/88 |
| 3,326,713 | A * | 6/1967 | Smith et al. | 442/71 |
| 4,339,566 | A * | 7/1982 | Rosenkranz et al. | 427/66 |
| 4,857,565 | A * | 8/1989 | Henning et al. | 523/343 |
| 5,035,029 | A * | 7/1991 | Horita et al. | 24/394 |
| 5,221,276 | A * | 6/1993 | Battrell | 604/389 |
| 5,326,605 | A * | 7/1994 | Ono et al. | 428/41.2 |
| 5,636,414 | A * | 6/1997 | Litchholt | 24/304 |
| 5,747,582 | A * | 5/1998 | Schutze et al. | 524/591 |

(Continued)

FOREIGN PATENT DOCUMENTS

DE 19646318 5/1998

(Continued)

*Primary Examiner*—Monica A Huson
*Assistant Examiner*—Jeff Wollschlager
(74) *Attorney, Agent, or Firm*—Roylance, Abrams, Berdo & Goodman, L.L.P.

(57) ABSTRACT

The invention relates to a method for producing a touch-and-close fastener element comprising a multitude of hook means, which are provided with a support as one piece and in the shape of stems with hook heads located at the ends thereof. Each of the hook heads is provided, at least in part, with an addition head part made of an additional material. A fastener system is produced from the respective head part being made from a duroplastic molding compound serving as the additional material. The fastener system can withstand a high temperature and mechanical stresses and lead to improved adhesion values and peel strength values during use.

40 Claims, 3 Drawing Sheets

U.S. PATENT DOCUMENTS 5,945,131 A * 8/1999 Harvey et al. ..... 425/141
5,956,816 A * 9/1999 McCrink ..... 24/113 MP
5,985,406 A * 11/1999 Takizawa et al. ..... 428/99
6,106,922 A 8/2000 Cejka et al.
6,287,665 B1 * 9/2001 Hammer ..... 428/100
6,393,673 B1 * 5/2002 Kourtidis et al. ..... 24/304
6,489,003 B1 * 12/2002 Levitt et al. ..... 428/100
6,540,863 B2 * 4/2003 Kenney et al. ..... 156/244.25
6,569,374 B1 * 5/2003 Poulakis ..... 264/447
7,018,496 B1 * 3/2006 George et al. ..... 156/152
2004/0259970 A1 * 12/2004 Lockhart et al. ..... 522/84

FOREIGN PATENT DOCUMENTS

DE 19906008 8/2000
DE 19952417 5/2001
DE 10106705 4/2002
EP 0894448 2/1999
EP 0894448 A1 * 3/1999
EP 0 894 448 B1 * 5/2001
WO WO9820767 * 5/1998
WO 9857565 12/1998
WO 0048812 8/2000

* cited by examiner

METHOD FOR PRODUCING A TOUCH-AND-CLOSE FASTENER ELEMENT

FIELD OF THE INVENTION

The invention relates to a method for production of a fastener element having a plurality of interlocking members integral with a backing. The interlocking members are in the form of stalks having interlocking heads on their ends. The interlocking heads are each provided at least in part with an additional head element of an added material.

BACKGROUND OF THE INVENTION

DE 196 46 318 A1 discloses a process for producing a fastener element having a plurality of interlocking means in the form of stalks having enlargements integral with a backing strip, these enlargements forming the interlocking heads. In the disclosed process preferably a thermoplastic in a plastic or liquid state is introduced into a gap between a press roller and a shaping roller, such shaping roller being provided with cavities open outward and inward and both rollers being rotated in opposite directions, so that the backing strip is formed in the gap between the rollers. The interlocking means, on the other hand, are produced in the cavities of the screen shaping roller. The shape of the interlocking heads may then be additionally modified by a subsequent calendering process. The interlocking heads produced in this manner may be in the form of circular, cylindrical, or oblate heads or in the form of an oblate polyhedron such as a hexagon. If the interlocking heads consist of a conventional plastic material such as a polyester or the like, they are especially sensitive to the amount of heat applied and may also be damaged by scratching or the like to the extent that they are no longer capable of performing their function.

The interlocking heads produced in this manner are used for interlocking with the customary interlocking loops of a corresponding fastener element. The detachable mechanical fastener is effected by interlocking for the purpose of the interlocking members and the interlocking loops of the two associated fastener elements as a whole. The interlocking takes place when the loops of the corresponding fastener element are engaged below the projections which are formed between the bottom of the interlocking heads and the associated stalks. The stalks are an integral component of the backing or backing strip and support the interlocking heads at their free ends. The interlocking heads are configured on their free ends or over their surface as small oblate bodies. During the interlocking process the loops are pressed down and accordingly flattened by the interlocking heads, with the result that they are not available at the outset for a successful interlocking process. A comparable situation also arises when the otherwise elevated loop material has already been flattened on the associated backing strip, so that to this extent the interlocking heads of the other fastener element encounter difficulty in engaging the loop. In situations such as this the disengagement strength values typical of fasteners are greatly reduced and fastening becomes correspondingly more difficult.

In order to deal with this disadvantage effectively, it has been proposed in the state of the art that the shaping or configuration of the interlocking heads be favorably affected in such a way that these disadvantages are at least in part offset. For example, WO 98/57565 presents a known production process for comparable fasteners, one in which the stalks integrated with the backing are delivered to a tapered shaping gap, a shaping roller with closed cylindrical circumference pressing the ends of the stalks flat to form interlocking heads. The round, oblate interlocking heads as thus produced are provided on their free ends, that is, over their upper sides, with incisions and notches. This has the result that the material of a head is weakened in the area in which the incisions or notches are made, to the extent that a tip is formed and the reduced tip points in the material become movable to form a hinge, to the extent that they slip past the loops directed toward them and can effect interlocking when they snap back to their initial position. In this way the disengagement strength values and accordingly fastening of the corresponding fastener elements is appreciably improved, but the process, to be carried out in multiple steps, is complex and accordingly cost-intensive. If the process as disclosed is applied to very small fastening means, also designated as "microfasteners" in technical language, this disclosed process can not be employed, since, when the notches or incisions are introduced into the material of the head, they then cut through this material, which consequently becomes unserviceable. In addition, the material of the head is sensitive to the action of heat and to scratching.

In contrast, another generic process proposed in EP 0 894 448 A1 is a process in which the respective interlocking head is provided on its free end with an additional head element of an adhesive containing an acrylate, in order to improve the fastening effect and the disengagement strength values. Known head elements consist essentially of a so-called "hot-melt" pressure-sensitive adhesive based on an acrylate. The adhesive in question for the head elements should ensure that better interlocking of the components will take place in addition to interlocking of the head elements with the loop material. It has been found, however, that, because of the adhesive property of the head elements, the loops are simply joined adhesively to the fastener element with the interlocking means and engagement with interlocking means in the form of interlocking heads is simply not even significant, so that the engagement is determined more or less by the adhesive itself and not by the respective interlocking means selected. Consequently, it is still desired to use engagement of the fastener element with the interlocking means because of the hot-melt adhesive, in the case of loop material fouled with baby powder, baby oil, or the like. However, an adhesive connection is effected in this manner rather than engagement by way of the interlocking means in the form of the interlocking heads themselves. Since the joining accordingly results essentially from the adhesive, the engagement or disengagement strength values thereby obtained are not to be considered adequate. In addition, the adhesive head element cannot protect the interlocking head itself from heat.

SUMMARY OF THE INVENTION

One object of the invention is a further improvement in the processes for producing fastener systems which can both withstand high temperatures and mechanical stresses. The fasteners result in better engagement and disengagement properties when appropriately configured, even under difficult conditions under which the loop material of a corresponding fastener element is subjected to fouling and/or can engage in the interlocking process proper only with difficulty when in a horizontal position. The object as formulated in these terms is attained by a process having the characteristics specified herein.

In the invention, the respective head element is made up of a duroplast moulding compound, the respective associated interlocking head is provided with a hard protective layer so that the otherwise sensitive plastic material of the interlocking head is adequately protected from heat and mechanical damage. Remarkably, a kind of protective layer or protective cap making up a head element can ensure performance of the function of the subjacent interlocking head even at very high temperatures which may be as high as several hundred degrees centigrade. In addition, the surface of the hardenable duroplast moulding compound, noted for its stability of shape, becomes so hard that mechanically applied damaging forces, ones which result from scratching, for example, are resisted by the head element to the extent that the interlocking head itself is not damaged. Consequently, a strong interlocking is ensured for the head element as well as the head element, even when the head element is subjected to damaging effects.

The head elements, which form a rigid connection to the interlocking means, can, with their protective effect, be designed so that they form a sort of anchor surface which during connection of the fastener elements facilitate sliding of the loop material past the interlocking head itself, with the result that the loop material does not come to rest on the material of the head but slides by it to complete an interlocking process to the fullest extent. This also applies to the situation in which the corresponding fastener element itself is provided with interlocking means in the form of interlocking heads or is made up of thread-like connecting means or the like. The result is an appreciable increase in the adherence effect or disengagement strength values, something which also applies to a situation in which the corresponding interlocking means are fouled by powder or oil or are available as loop or thread come to rest on the backing strip of the corresponding fastener element for later interlocking. The hard duroplast moulding compound promotes sliding of the head element past the loop. This in turn results in good interlocking behavior of the respective fastener, even when the interlocking means used in formation of the microfastener are decidedly small in geometric terms.

In one preferred embodiment of the process of the invention it has been found to be favorable to select as initial material for the fastener element such substances as polyesters, polyolefins, polyamides, elastomers, and especially thermoplastic urethanes or, if desired, mixtures of these materials to the extent that they are compatible. Use may also be made of cross-linkable acrylates.

In another especially preferred embodiment of the process claimed for the invention, at least the tops of the interlocking heads facing away from the stalks are pretreated so that reactive groups, such as OH groups, are obtained to increase the surface energy, so that the duroplast material subsequently applied more efficiently forms a rigid connection with the interlocking heads. The pretreatment processes applied may be by the introduction of heat by means of flames, corona or plasma processes or application of electric or electromagnetic rays and corresponding fields. It is also advantageous to fluorinate the tops of the stalks. This yields especially favorable results in later bonding or interlocking with head elements of duroplast moulding compounds.

In another preferred embodiment of the process of the invention an acrylate material, urethane diacrylate in particular, is used as duroplast moulding compound. In addition to a photoinitiator, a reactive solvent can be used to adjust the viscosity of the acrylate material for the subsequent process of application to the interlocking heads.

In one especially preferred embodiment of the process of the invention the materials making up the elements of the head are applied to the interlocking heads by way of an applicator roller or by means of another application device. The shape of the head element can be obtained cost effectively in this way.

In another preferred embodiment of the process of the invention the applicator roller moves in the direction opposite that of a feed roller which conveys one fastener element. The material forming the head elements is fed between the applicator roller and a mating roller that are driven in the same direction. As a result, the process can be operated continuously and the application gap between feed roller and applicator roller is selected so that the respective head is applied virtually without subjecting to forces and accordingly with no application of additional pressure to the interlocking heads. It is surprising to find that, during the configuration for the purpose and ultimately also as a result of the surface energy of the acrylate material, head elements may be mounted on the oblate interlocking heads which are more or less hemispheric in shape. This is especially favorable for the subsequent introduction of the interlocking means into the associated loop material.

In another preferred embodiment of the invention for the production of a fastener element, a plastic in the plastic or liquid state is fed to a gap between a press roller and a shaping roller. The shaping roller is shaped to form the stalks and the interlocking heads, and includes screen-like cavities which mates with the press roller to form a gap so that the backing is formed in the gap as the rollers move in opposite directions. The fastener element with the interlocking means may be prepared cost-effectively in this way for subsequent mounting of the head elements.

In another preferred embodiment of the process of the invention ultraviolet light is applied to the interlocking heads in order to harden the material making up the head elements. If cold light is used, the possibility exists of also stopping the production process without damage to the heads of the interlocking material when energy is introduced during hardening. A comparable result may be achieved if the hardening process is conducted in a chamber containing an inert gas such as nitrogen when ultraviolet light is used.

These and other features of the invention will become apparent from the following detailed description of the invention.

BRIEF DESCRIPTION OF THE DRAWINGS

The process claimed for the invention is described in what follows with reference to the drawing, in which, in the form of diagrams not drawn to scale.

DETAILED DESCRIPTION OF THE INVENTION

Figure 1:
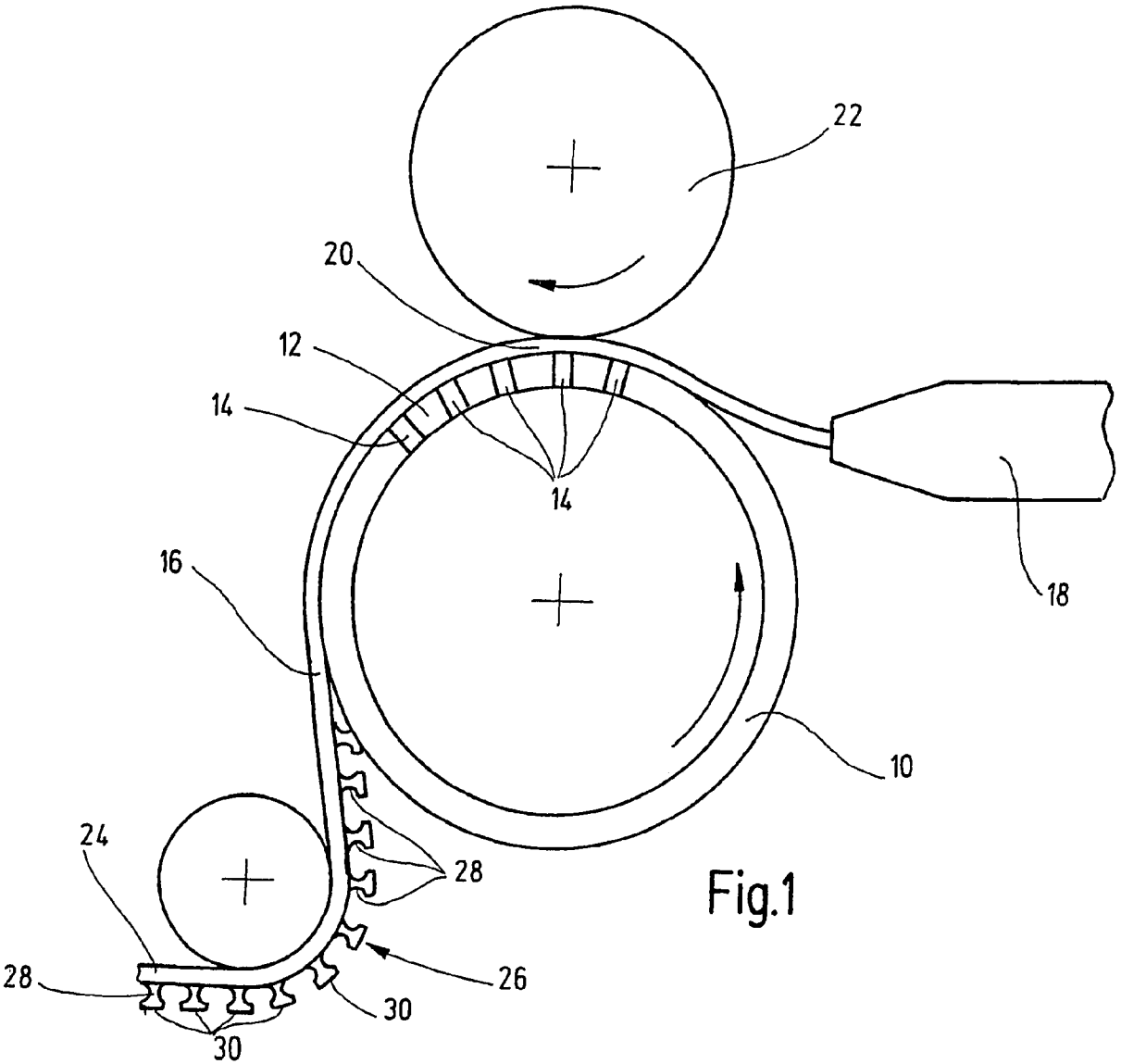
FIG. 1 shows a known production process for production of a fastener element as initial material for subsequent mounting of head elements on the interlocking heads.

FIG. 1 shows a shaping roller designated as a whole as 10 on which a screen 12 is mounted. The screen 12 of the shaping roller 10 has distributed over its entire circumference cavities 14 which are etched by a galvanic process. These cavities 14 may have a more or less cylindrical basic shape, as is the case in FIG. 1. Any other shape may also be etched in, however, as a function of the geometric configuration of the interlocking heads desired. For the sake of simplification not all cavities 14 are shown in FIG. 1, only a section of a plurality of cavities which extend both inside the plane of the drawing and perpendicular thereto in a plurality of other planes not shown.

To produce a fastener element 16 in only one operating cycle, a plastic material is fed by conventional means in plastic or fluid form of a feed device 18 in the form of an extruder to the gap 20 between the press roller 22 and the shaping roller 10. As the arrows in FIG. 1 indicate, the press roller 22 and the shaping roller 10 are driven in opposite directions of rotation, so that the plastic released from the extruder may enter the gap 20 and flow into the subjacent cavities 14. There is formed in the gap 20 a backing 24 which may be in the form of a strip or a larger sheet surface. The interlocking means designated as 26 as a whole formed in the cavities 14 are then integrated with this backing 24. The interlocking means 26 in question consist of individual stalks 28 (see FIG. 3) on the free end of which the oblate interlocking heads are present. To form the head shapes the interlocking heads 30 also undergo a calender process (not shown) after the shaping in accordance with FIG. 1, where a calender roller dresses the tops of the interlocking heads 30. The interlocking heads may form cylindrical, polygonal, and in particular hexagonal or octagonal, external profiles (not shown), as a function of the cross-sectional shapes of the cavities 14. The interlocking heads 30 additionally have cavities or recesses 32 on their free upper surface, depending on the shaping process.

It is customary to form the backing 24 with a thickness of 0.05 mm to 0.3 mm, preferably from 0.1 to 0.2 mm. The number of interlocking means is generally in the range of from 50 to 500 interlocking heads per $cm^2$, depending on the application. Materials such as polyesters, polyolefins, polyamides, elastomers, and thermoplastic urethanes or mixtures of these substances may be used as initial materials for the fastener element 16. Use may also be made of cross-linkable acrylates.

Figure 3:
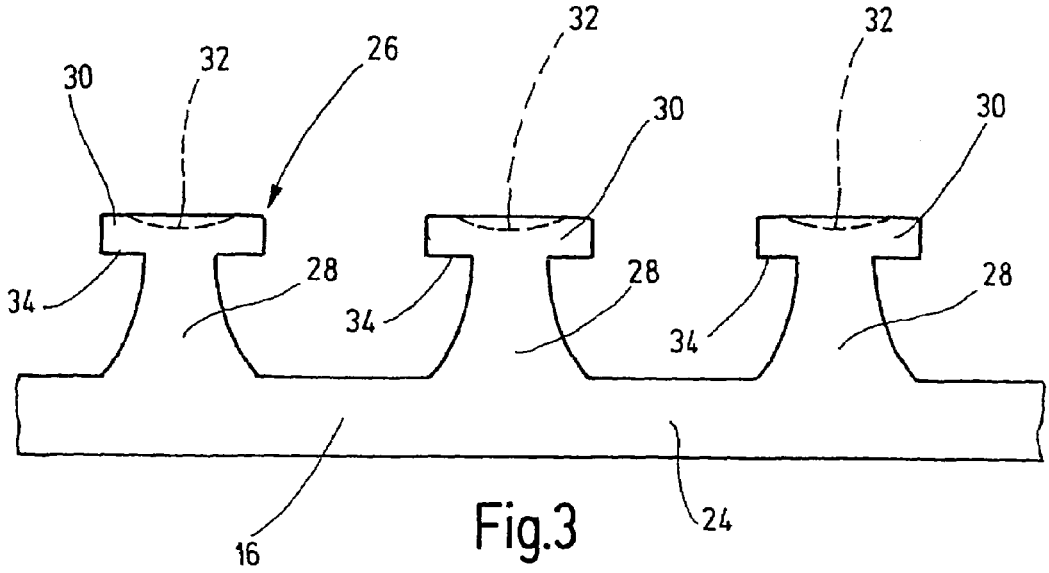
FIGS. 3 and 4 show the interlocking material of FIG. 1 and, respectively, the head elements obtained as shown in FIG. 2 with the cap-shaped head elements mounted on them.

The fastener material obtained as shown in FIG. 1 is an enlarged diagram in FIG. 3. If the fastener element 16 is combined with the loop material of a corresponding fastener element (not shown) to form a customary fastener (not shown), individual loops obviously come to rest on the top of the oblate head material as shown in FIG. 3. The loops are no longer available for an interlocking process, while the individual loops engage the respective associated interlocking head 30 on its lower side 34 and effect interlocking in this way. The process claimed for the invention serves to improve this initial situation. In order to improve the effect of engagement of the loops in question of a corresponding fastener element (not shown), it is provided in accordance with the process claimed for the invention that the interlocking heads are subsequently provided with an additional head element 36 which consists of a duroplast moulding compound.

The respective head element 36 is accordingly in the form of a non-adhesive and shape-stable duroplast material (thermosetting resin). The heat-resistant and smooth duroplast material both ensures protection of the interlocking heads from damage originating in the environment and makes certain that the interlocking material of the other corresponding fastener element, in the form of loops, for example, can slide past the duroplast head element. This facilitates the interlocking process and results in high adherence forces and disengagement strength values. The interlocking material of the corresponding fastener element no longer comes to rest on the head elements, because of the smooth design of the duroplast material.

In order to achieve good interlocking of the interlocking heads 30 and the head elements 36, formation of reactive groups such as OH groups is effected on the always free upper sides of the interlocking heads 30. This increases the surface energy, so that the duroplast head elements 36 are rigidly connected to the interlocking heads 30. The upper sides of the interlocking heads 30 can be treated by a thermal treatment process such as the application of flames. A plasma process or so-called corona process can also be used. Another option is represented by fluorinating the interlocking heads 30.

An acrylate material, especially a urethane diacrylate, may be used as duroplast moulding compound. A reactive solvent may be added for viscosity adjustment. In addition, the process of hardening the duroplast moulding compound may be controlled, accelerated in particular, by means of a photoinitiator. The following is one possible formulation. The common, trademarked commercial names are indicated:

1. 60 parts EBECRYL EB 483S (hard, oligomeric urethane diacrylate);

2. 30 parts EBECRYL EB 230 (soft, oligomeric urethane diacrylate);

3. 8 parts reactive solvent such as HDDA (monomeric diacrylate); and 4. 2 parts photoinitiator such as DAROCURE DC 1173.

Figure 2:
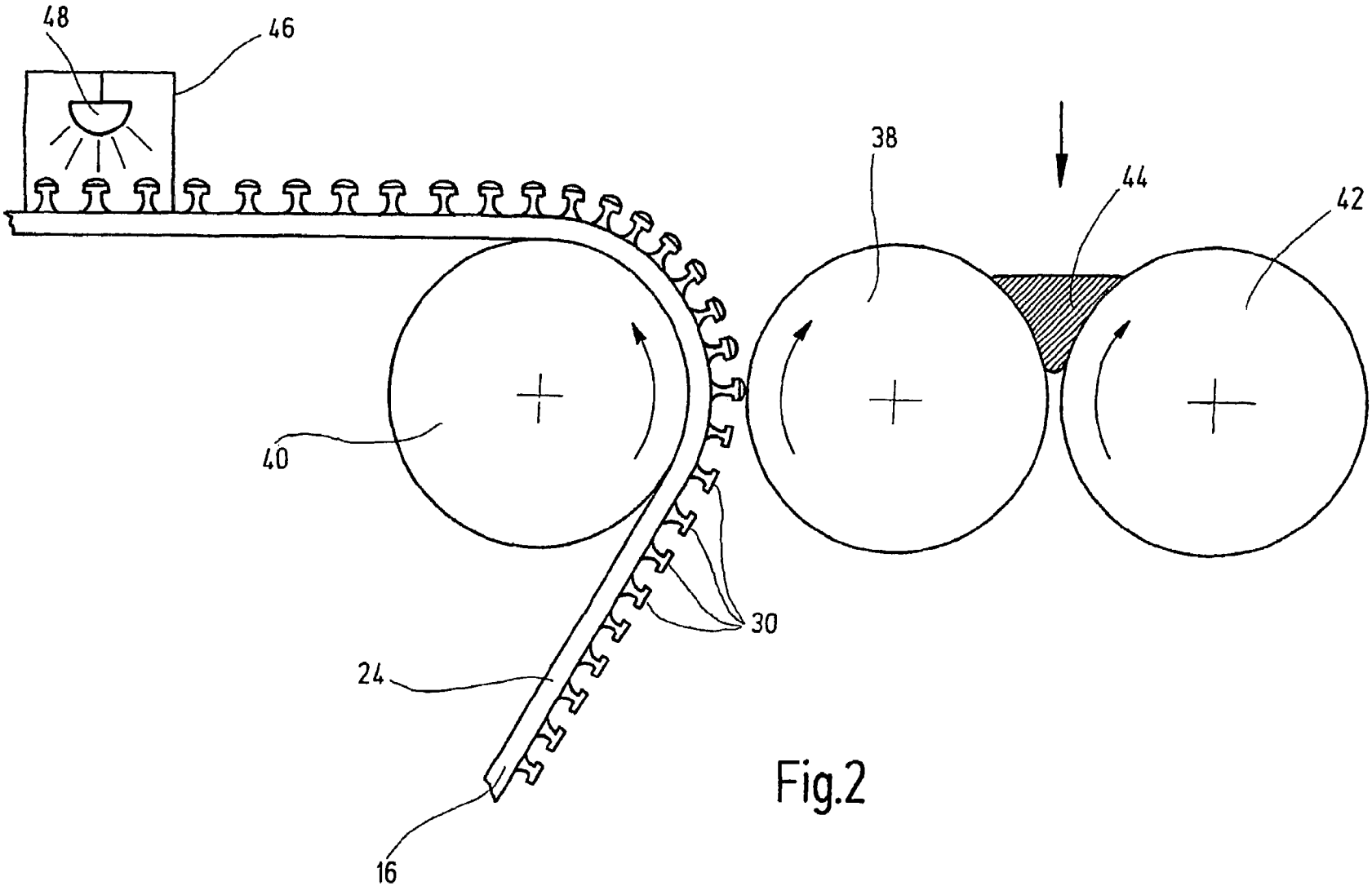
FIG. 2 the process claimed for the invention for mounting the head elements on the initial interlocking material shown in FIG. 1.

As shown in FIG. 2 in particular, the materials forming the head elements 36 are applied to the interlocking heads 30 by way of an applicator roller 38. The respective applicator roller 38 is moved in the direction opposite that of a conveyor roller 40 which conveys the fastener element 16, the material making up the head elements 36 being delivered to the applicator roller between the applicator roller 38 and a mating roller 42 driven in the same direction. Since the acrylate material is of a consistency and viscosity similar to that of honey, it is in the form of a kind of deposit bath 44 between the applicator roller 38 and the mating roller 42 and can there be brought out gradually by the applicator roller and then delivered to the fastener element 16. The deposit bath 44 may, as indicated by the arrow in FIG. 2, be replenished by a feed device not shown in proportion to the amounts removed.

Figure 4:
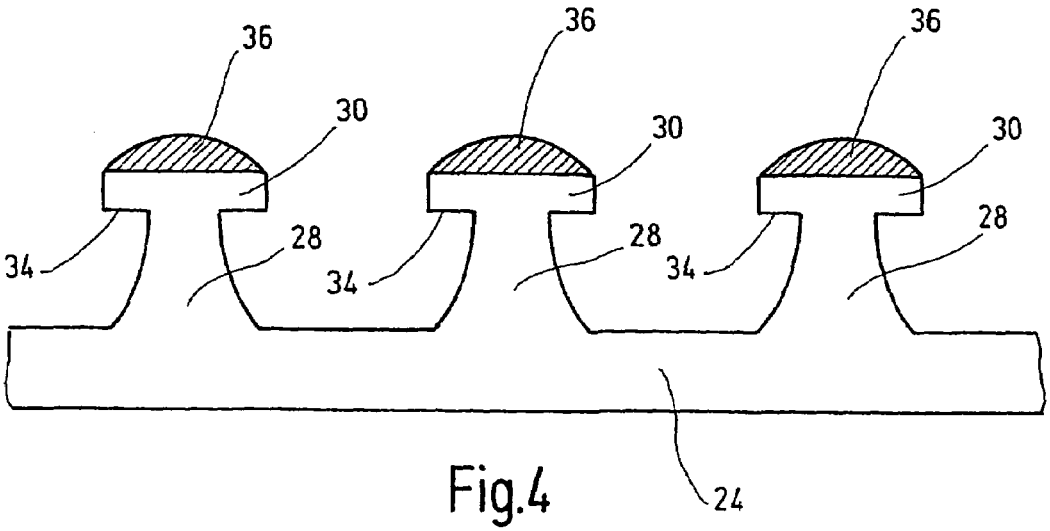

The configuration selected for the gap between applicator roller 38 and conveyor roller 40, including the speeds of rotation of these rollers, is such that no additional pressure is applied to the interlocking heads 30 if the acrylate material is applied by way of the applicator roller 38. The surface tension then selected, that of the acrylate material in particular, is such that a kind of drop formation is achieved, with the result that, as illustrated in FIG. 4 in particular, the head elements 36 form hemispherical caps. For the sake of greater clarity of illustration, the head elements 36 are identified by hatching in FIG. 4, but in reality hardly any difference is to be detected between the subsequently applied head elements 36 and the initial material of a fastener element 16, as is to be seen after production as shown in FIG. 2.

If a loop of the corresponding fastener now encounters the interlocking caps of the head elements 36, such loops cannot come to rest there but slide to the side on the rounded surfaces until they reach the area of the lower sides 34 of the interlocking heads 30 and reliably effect fastening there. A kind of aid to penetration is created in this way, one which results in improved interlocking and disengagement strength values, so that the fastening is improved even if the loops are no longer properly oriented toward the corresponding fastener but have already come to rest on the upper side of the backing. Because of the good sliding property of the hard duroplast material selected, the respective sliding process is nevertheless initiated at least in part even if the head element 36 forms an oblate surface (not shown).

A hardening device 46 such as one provided with an ultraviolet lamp 48 is used to harden the head elements 36 in question. The ultraviolet lamp used may also be in the form of a cold light or the like.

If the interlocking heads 30 have the recesses 32 on their upper side, the duroplast moulding compound of the head elements 36 also enters the cavities, this further improving engagement with the interlocking means 26. Even if the loop material is fouled, for example, is covered with baby powder, the sliding process involved is not impaired by the fouling, so that an interlocking effect distinctly improved in comparison to known solutions is achieved.

While various embodiments were selected to illustrate the invention, it will be understood by those skilled in the art that various changes and modifications can be made without departing from the scope of the invention as defined in the appended claims.

The invention claimed is:

1. A process for producing a fastener element having a plurality of interlocking members integral with a backing and with stalks having interlocking heads on ends thereof, each interlocking head being provided with an additional head element formed from a non-adhesive duroplast moulding compound, each additional head element being formed only on the top surface of the respective interlocking head to form a hard protective convex cap member which completely covers the end of the respective interlocking head, each hard protective cap member being harder than a material of the interlocking heads and having a hardness sufficient to resist wear and to facilitate sliding over a second interlocking member.

2. The process of claim 1, wherein the fastener element is formed from materials selected from the group consisting of polyesters, polyolefins, polyamides, elastomers, thermoplastic urethanes, and mixtures thereof.

3. The process of claim 1, further comprising the step of:

pretreating at least the upper sides of the interlocking heads facing away from the stalks by means of a flame, a corona or plasma process, electric or electromagnetic rays and fields, or by fluorination.

4. The process of claim 1, wherein the duroplast molding compound is an acrylate.

5. The process of claim 1, wherein the duroplast molding compound is a urethane diacrylate.

6. The process of claim 1, wherein the duroplastic moulding compound is provided with a photoinitiator and/or with a reactive solvent.

7. The process of claim 1, wherein the material forming the head elements is applied to the ends of the interlocking heads by an applicator roller.

8. The process of claim 7, wherein the applicator roller moves in the direction opposite that of a conveyor roller which serves to convey the fastener element, and wherein the added material making up the head elements is delivered to the applicator roller between the applicator roller and a mating roller driven in the same direction.

9. The process of claim 1, wherein a plastic in a plastic or liquid state is delivered to a gap between a press roller and a shaping roller which is provided with screen-like cavities for forming the stalks and interlocking heads and where the press roller and the shaping roller rotate in opposite directions to form the backing in the gap.

10. The process of claim 1, wherein energy is supplied to the interlocking heads to thermoset the added material forming the head elements.

11. The process of claim 10, wherein the material forming the head element is cured by ultraviolet radiation or heat.

12. The process of claim 1, wherein said head elements have a hardness sufficient to resist heat and mechanical damage to the interlocking members.

13. The process of claim 1, wherein each protective member enables the head element to slide past a loop of a hook and loop type fastener.

14. The process of claim 1, wherein each protective head element is a shape-stable material.

15. The process of claim 1, wherein each protective head element has a smooth surface to enable a fastener element to slide over the head element.

16. The process of claim 1, wherein said interlocking members have a substantially mushroom shape formed by said stalks and interlocking heads.

17. The process of claim 16, wherein said interlocking heads have a concave top surface and wherein said additional head element is formed on said concave top surface.

18. The process of claim 1, wherein said stalks extend upwardly substantially perpendicular to said backing, and said interlocking heads being formed on a top end of said stalks; and said interlocking heads have a width greater than a width of said stalks, said additional head element having a bottom surface attached directly to a top surface of said interlocking head, and a rounded top surface.

19. The process of claim 18, wherein said top surface of said interlocking head has a flat portion and where said additional head element is formed on said flat portion.

20. A fastener obtained by the process of claim 1.

21. A process for producing a fastener comprising the steps of:

molding a fastener element having a backing, integral with a plurality of interlocking members extending upwardly from said backing, each of said interlocking members having a stalk with an interlocking head with a top end; and forming non-adhesive, hard protective head convex cap elements only on the top surface of a respective interlocking head and which completely covers the top surface, the hard protective head cap elements being harder than a material of the interlocking members and having a hardness sufficient to resist wear and to facilitate sliding over a second interlocking head.

22. The process of claim 21, wherein said process further comprises applying a curable composition to the top ends of the interlocking members and curing the curable composition to form said protective head elements.

23. The process of claim 21, wherein said protective head elements have a hardness sufficient to resist heat and mechanical damage to the interlocking members.

24. The process of claim 21, wherein said top ends of said interlocking members have a recessed outer surface, wherein said process further comprises applying a curable composition to said recessed outer surface and curing said composition to form each said protective head element.

25. The process of claim 21, wherein each said protective head element is non-adhesive, is sufficiently rigid to retain its shape, and forms a substantially smooth end surface on the interlocking members.

26. The process of claim 21, wherein the fastener is made from at least one material selected from the group consisting of polyesters, polyolefins, polyamides, elastomers, thermoplastic urethanes, and mixtures thereof.

27. The process of claim 21, wherein at least the upper sides of the interlocking members are pretreated prior to forming the protective heads by a flame, a corona or plasma process, electric or electromagnetic rays and fields, or by fluorination.

28. The process of claim 21, wherein each protective head element is formed from an acrylate.

29. The process of claim 28, wherein the acrylate is a urethane acrylate.

30. The process of claim 22, wherein the curable composition includes a photoinitiator and/or a reactive solvent.

31. The process of claim 22, wherein the curable composition is applied to the interlocking members by an applicator roller.

32. The process of claim 31, wherein the applicator roller rotates in the direction opposite that of a conveyor roller to convey the fastener, and wherein the curable composition is supplied to the applicator roller between the applicator roller and a mating roller rotated in the same direction.

33. The process of claim 21, further comprising:

delivering a plastic in a plastic or liquid state to a gap between a press roller and a shaping roller for forming the backing, the shaping roller having screen-like cavities for formation of the interlocking members.

34. The process of claim 22, further comprising the step of:

applying ultraviolet radiation and/or heat to cure the curable composition applied to the ends of the interlocking members.

35. The process of claim 21, wherein each protective head element enables the interlocking head to slide past a loop of a hook and loop type fastener.

36. The process of claim 21, wherein each protective head element is a shape-stable material.

37. The process of claim 21, wherein each protective head element has a smooth surface to enable a fastener element to slide over the head element.

38. The process of claim 21, wherein said interlocking heads have a substantially mushroom shape formed by said stalks and interlocking heads.

39. The process of claim 21, wherein said interlocking heads have a concave portion in a top surface; and said hard protective head element is formed on said top surface.

40. A fastener obtained by the process of claim 21.

* * * * *